US011071174B2

(12) United States Patent
Antoinette et al.

(10) Patent No.: US 11,071,174 B2
(45) Date of Patent: Jul. 20, 2021

(54) DIRECTED INFRARED RADIATOR ARTICLE

(71) Applicant: Nanocomp Technologies, Inc., Merrimack, NH (US)

(72) Inventors: Peter L. Antoinette, Nashua, NH (US); David Gailus, Merrimack, NH (US); Eitan Zeira, Hollis, NH (US)

(73) Assignee: Nanocomp Technologies, Inc., The Woodlands, TX (US)

( * ) Notice: Subject to any disclaimer, the term of this patent is extended or adjusted under 35 U.S.C. 154(b) by 702 days.

(21) Appl. No.: 15/299,763

(22) Filed: Oct. 21, 2016

(65) Prior Publication Data

US 2017/0118799 A1 Apr. 27, 2017

Related U.S. Application Data

(60) Provisional application No. 62/245,341, filed on Oct. 23, 2015.

(51) Int. Cl.
*H05B 3/14* (2006.01)
*H05B 3/24* (2006.01)

(52) U.S. Cl.
CPC ..... *H05B 3/145* (2013.01); *H05B 3/24* (2013.01); *H05B 2203/01* (2013.01); *H05B 2203/011* (2013.01); *H05B 2214/04* (2013.01)

(58) Field of Classification Search
CPC ..... H05B 2203/01; H05B 2203/011; H05B 2214/04; H05B 3/145; H05B 3/24
USPC ..... 392/407; 423/447.1, 447.7, 445 B; 977/742–754, 842–848; 205/171, 189, 205/191, 192, 193, 220, 224; 428/114,
(Continued)

(56) References Cited

U.S. PATENT DOCUMENTS

| | | | |
|---|---|---|---|
| 3,468,594 | A | 9/1969 | Vogl et al. |
| 5,459,327 | A | 10/1995 | Nomura |
| 7,993,620 | B2 | 8/2011 | Lashmore et al. |

(Continued)

FOREIGN PATENT DOCUMENTS

| | | | |
|---|---|---|---|
| EP | 2835375 | | 2/2015 |
| JP | H03280382 | A | 12/1991 |
| JP | 2010254566 | A | 11/2010 |

OTHER PUBLICATIONS

International Search Report in International Patent Application No. PCT/US2016/058190 dated Jan. 10, 2017.

*Primary Examiner* — Dana Ross
*Assistant Examiner* — Ket D Dang
(74) *Attorney, Agent, or Firm* — Nanocomp Technologies, Inc.; Lewis Craft

(57) ABSTRACT

Articles for emitting infrared energy comprising a nanostructured member including a plurality of nanotubes, the member being configured to emit infrared energy when an electrical current is applied; a reflecting member configured to direct at least a portion of the emitted infrared energy in a desired direction for heating a remotely-situated target, and optionally a spacer situated between the nanostructured member and the reflecting member to maintain a predetermined spacing there between, the predetermined spacing selected to minimize destructive interference between the infrared energy emitted by the nanostructured member and the infrared energy reflected by the reflecting member. In alternative embodiments, a carbonaceous member may be substituted for the nanostructured member.

19 Claims, 7 Drawing Sheets

(58) Field of Classification Search
USPC ..... 428/137, 304.4, 141, 408, 188; 257/E21.002, E21.532, E23.11
See application file for complete search history.

(56) References Cited

U.S. PATENT DOCUMENTS

| | | | | |
|---|---|---|---|---|
| 8,080,487 | B2 | 12/2011 | Gardner et al. | |
| 8,630,091 | B2 | 1/2014 | Ward et al. | |
| 2006/0062944 | A1* | 3/2006 | Gardner | B82Y 30/00 428/34.1 |
| 2007/0036709 | A1* | 2/2007 | Lashmore | D01F 9/127 423/447.1 |
| 2007/0110413 | A1* | 5/2007 | Konishi | F24C 7/065 392/407 |
| 2009/0044848 | A1* | 2/2009 | Lashmore | H01L 35/22 136/201 |
| 2009/0277897 | A1* | 11/2009 | Lashmore | H05B 3/34 219/544 |
| 2009/0283744 | A1* | 11/2009 | Jiang | H01L 29/458 257/9 |
| 2010/0075925 | A1 | 3/2010 | Torti et al. | |
| 2010/0188833 | A1* | 7/2010 | Liang | H01B 1/04 361/818 |
| 2010/0327247 | A1* | 12/2010 | Ward | H01L 45/1286 257/2 |
| 2011/0005808 | A1* | 1/2011 | White | H02K 3/02 174/126.2 |
| 2011/0026758 | A1* | 2/2011 | Wang | H04R 7/14 381/398 |
| 2011/0056928 | A1 | 3/2011 | Feng et al. | |
| 2011/0204330 | A1* | 8/2011 | LeMieux | H01L 29/15 257/15 |
| 2011/0220191 | A1* | 9/2011 | Flood | B82Y 10/00 136/255 |
| 2012/0060826 | A1* | 3/2012 | Weisenberger | B82Y 30/00 126/569 |
| 2012/0171411 | A1* | 7/2012 | Lashmore | B32B 5/022 428/114 |
| 2012/0281276 | A1 | 11/2012 | Poirier et al. | |
| 2013/0341535 | A1* | 12/2013 | Owens | H04N 5/33 250/495.1 |
| 2015/0076137 | A1* | 3/2015 | Kim | H05B 3/20 219/553 |

* cited by examiner

DIRECTED INFRARED RADIATOR ARTICLE

CROSS-REFERENCE TO RELATED APPLICATION

This application claims priority to U.S. Provisional Application Ser. No. 62/245,341 filed Oct. 23, 2015, and entitled "Directed Infrared Radiator Article," the disclosure of which is hereby incorporated herein by reference in its entirety.

BACKGROUND

Heating by infrared radiation typically requires a source made hot by chemical reaction or electrical resistance. Such systems are inefficient, emitting their radiation across a broad range of wavelengths. The source can also be dangerous, with the potential to cause burns, accidentally ignite other materials, and deliver an electrical shock due to the often high amounts of electrical current required for their operation. These sources are often characterized by having large thermal masses, resulting in an extended length of time to heat up, as well as remaining dangerously hot for an extended period after being turned off.

SUMMARY

The present disclosure is directed to articles for emitting and directing infrared energy for heating a remote target. The articles may include a nanostructured member configured to emit infrared energy when an electrical current is applied and a reflecting member configured to direct at least a portion of the emitted infrared energy in a desired direction for heating the remotely-situated target.

The nanostructured member, in some embodiments, may include a plurality of intermingled nanotubes placed on top of one another to form a continuous structure having an adequate number of contact sites between adjacent nanotubes to provide the necessary bonding strength with sufficient structural integrity to be handled as a sheet. In one such embodiment, the nanostructured member may include a plurality of layers of non-woven nanotubes deposited on top of one another to form a phyllo-dough structure. Embodiments of the nanostructured member may have a nanotube area density of about 10 grams per square meter. In alternative embodiments, a carbonaceous member including at least one of graphene, graphite, carbon black, or other carbon-based material may be substituted for the nanostructured member. The reflecting member, in some embodiments, may be a self-standing reflective material, and in other embodiments, may include a reflective material deposited onto a substrate.

The nanostructured member and the reflecting member, in some embodiments, may be directly coupled to one another, and in other embodiments, may instead be separated by one or more spacers situated between the nanostructured member and the reflecting member. The thickness of the spacer may be selected to help minimize destructive interference between the infrared energy emitted from the nanostructured member and the infrared energy reflected by the reflecting member. The spacer may be tuned for maximizing overall radiated energy generally or for maximizing radiation of particular wavelength(s), such as those best for heating a specific target such humans or animals.

DESCRIPTION OF SPECIFIC EMBODIMENTS

The present disclosure is directed to heating articles, and in particular, to nanotube-based articles for generating and directing infrared energy for remote heating of an intended target, such as people, objects, and the like.

Figure 1A:
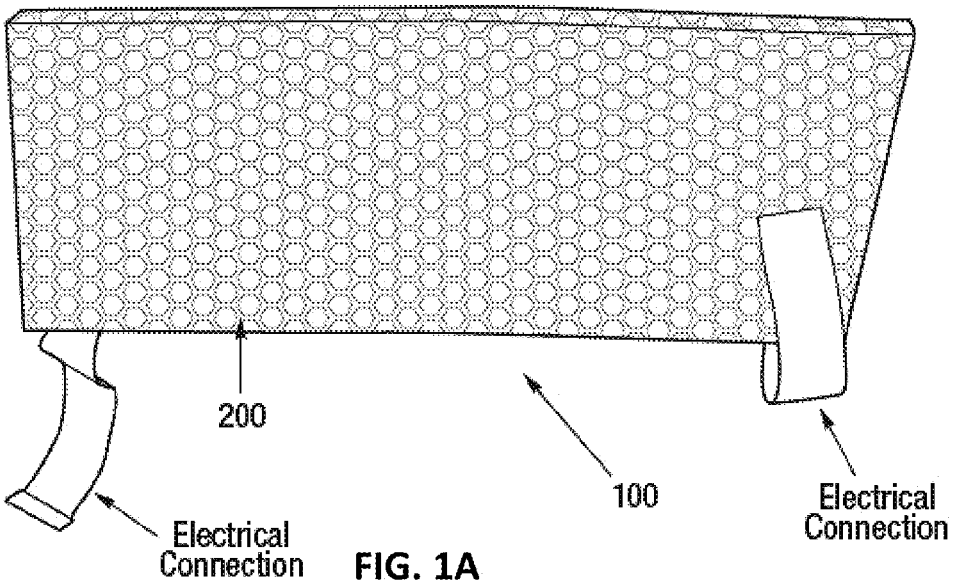
FIG. 1A depicts a planform view of a directed infrared heater according to an embodiment of the present disclosure.
Figure 1B:
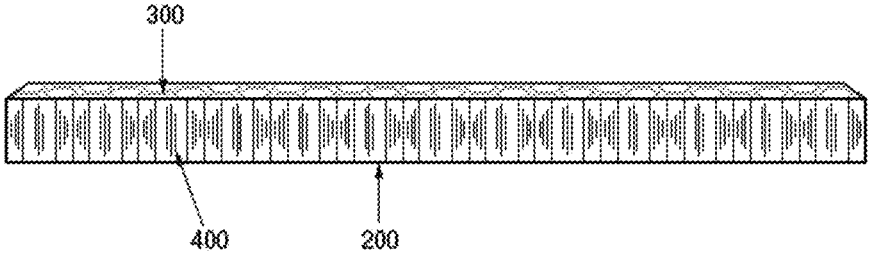
FIG. 1B depicts a cross-sectional view of a directed infrared heater according to an embodiment of the present disclosure.
Figure 2A:
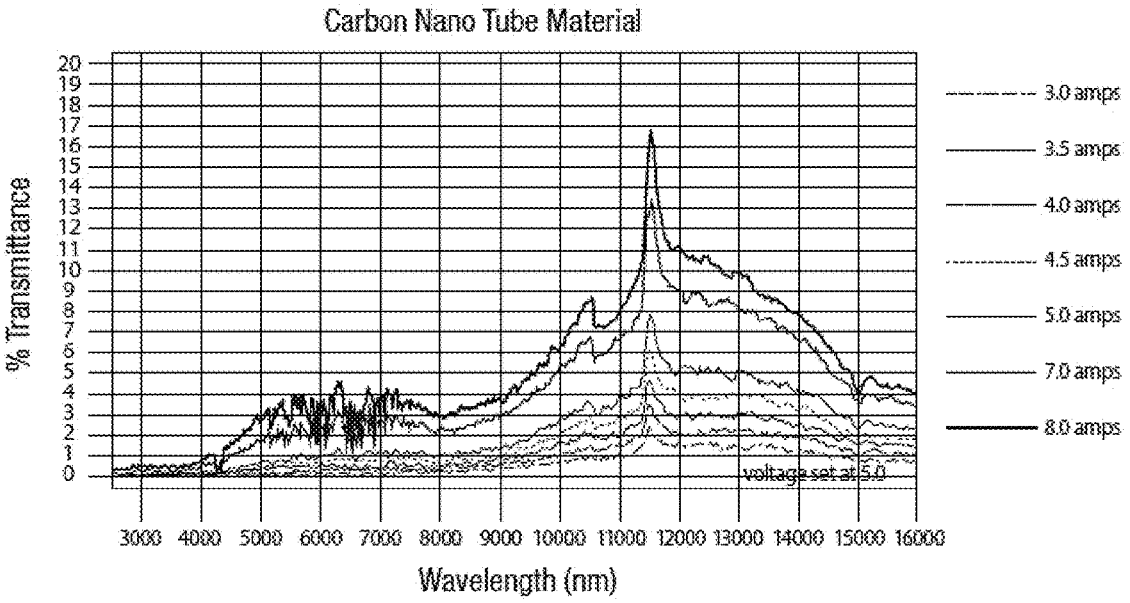
FIG. 2A illustrates transmittance as a function of wavelength for a representative carbon nanotube member according to an embodiment of the present disclosure.
Figure 2B:
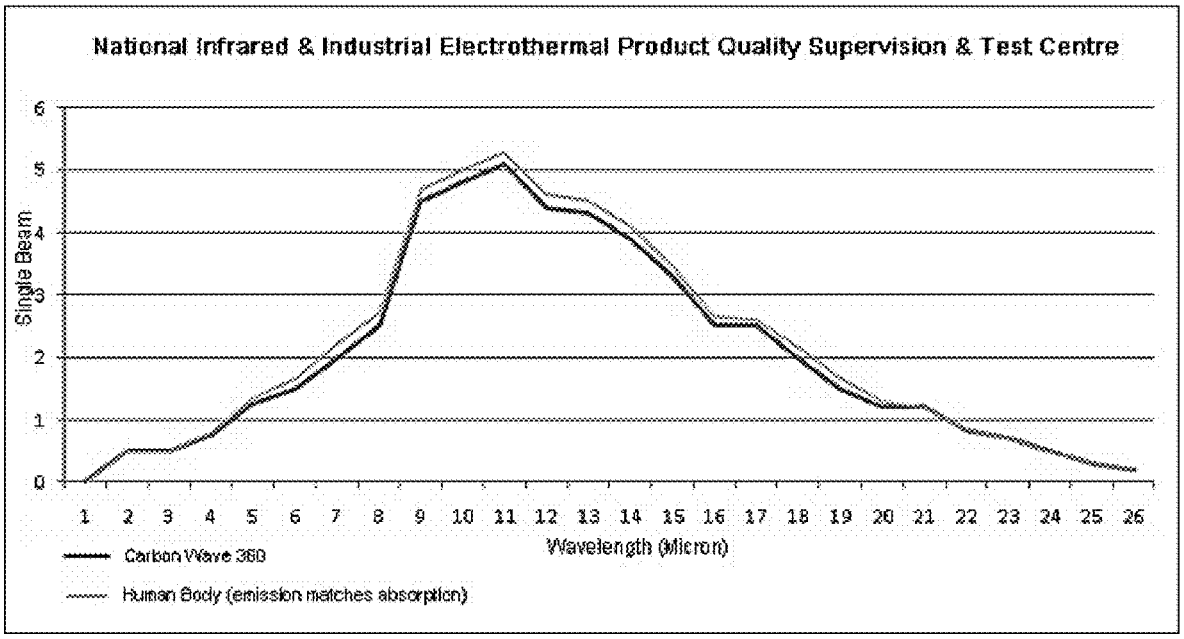
FIG. 2B illustrates representative human absorption characteristics for a spectrum of infrared wavelengths.

Referring to FIGS. 1A and 1B, directed infrared heater 100 of the present disclosure may generally include one or more carbon nanotube (CNT) members 200, one or more reflecting members 300, and one or more spacers 400. Electrical energy may be applied to CNT member 200 to generate infrared energy, and reflecting member 300 may serve to shape and direct the emitted energy towards a target to be heated. Carbon nanotubes, made in accordance with embodiments of the present invention, can act to efficiently radiate in the far infrared spectrum as a result of an electrical current passing through them, as shown in FIG. 2A. This creates an efficient heating article that is able to radiate in the far infrared in all directions without heating itself up. Remote infrared heating can be an efficient way to warm an intended target (e.g., people or objects), as it typically does not require having to warm up the air around the targeted person or object to achieve the desired heating effect. As shown in FIG. 2B and discussed in more detail later in this disclosure, studies have shown that infrared radiation within the range of about 8 microns to 12 microns may be best absorbed by the human body and thus may be best for human heating applications.

Figure 1C:
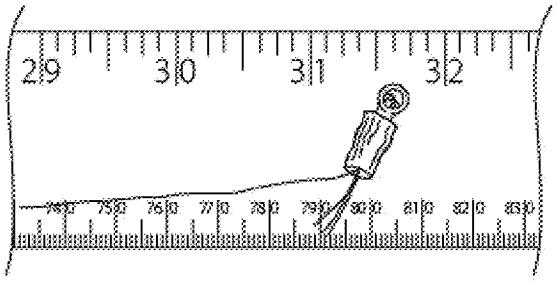
FIG. 1C depicts an electrical lead according to an embodiment of the present disclosure.

Electrical sources may be connected to CNT member 200 of the present invention in any suitable manner. In an embodiment, an input, such as one or more leads, may be connected mechanically, for example, via crimping as shown in FIG. 1C. In another embodiment, a conductive material, such as silver ink, may be deposited onto CNT member 200 to provide a suitable input or lead. In yet another embodiment, a glassy carbon precursor may be applied between the CNT member 200 and a metallic lead or other suitable input to enhance conductivity between the nanotubes of CNT member 200 and the metallic lead or other suitable input.

Presently, there exist multiple processes and variations thereof for growing nanotubes, and forming yarns, sheets or cable structures made from these nanotubes. These include: (1) Chemical Vapor Deposition (CVD), a common process that can occur at near ambient or at high pressures, and at temperatures above about 400° C., (2) Arc Discharge, a high temperature process that can give rise to tubes having a high degree of perfection, and (3) Laser ablation.

The present invention, in one embodiment, employs a CVD process or similar gas phase pyrolysis procedures known in the industry to generate the appropriate nanostructures, including carbon nanotubes. Growth temperatures for a CVD process can be comparatively low ranging, for instance, from about 400° C. to about 1350° C. Carbon nanotubes (CNTs), both single wall (SWNT) or multiwall (MWNT), may be grown, in an embodiment of the present invention, by exposing nanoscaled catalyst particles in the presence of reagent carbon-containing gases (i.e., gaseous carbon source). In particular, the nanoscaled catalyst particles may be introduced into the reagent carbon-containing gases, either by addition of existing particles or by in situ synthesis of the particles from a metal-organic precursor, or even non-metallic catalysts. Although both SWNT and MWNT may be grown, in certain instances, SWNT may be selected due to their relatively higher growth rate and tendency to form rope-like structures, which may offer advantages in handling, thermal conductivity, electronic properties, and strength.

The strength of the individual carbon nanotubes generated in connection with the present invention may be about 30 GPa or more. Strength, as should be noted, is sensitive to defects. However, the elastic modulus of the carbon nanotubes fabricated in the present invention may not be sensitive to defects and can vary from about 1 to about 1.2 TPa. Moreover, the strain to failure of these nanotubes, which generally can be a structure sensitive parameter, may range from a about 10% to a maximum of about 25% in the present invention.

Furthermore, the nanotubes of the present invention can be provided with relatively small diameter. In an embodiment of the present invention, the nanotubes fabricated in the present invention can be provided with a diameter in a range of from less than 1 nm to about 10 nm. It should be appreciated that the carbon nanotubes made in accordance with one embodiment of the present invention may be extended in length (i.e., long tubes) when compared to commercially available carbon nanotubes. In an embodiment of the present invention, the nanotubes fabricated in the present invention can be provided with a length in the millimeter (mm) range.

It should be noted that although reference is made throughout the application to nanotubes synthesized from carbon, other compound(s), such as boron, $MoS_2$, or a combination thereof may be used in the synthesis of nanotubes in connection with the present invention. For instance, it should be understood that boron nanotubes may also be grown, but with different chemical precursors. In addition, it should be noted that boron may also be used to reduce resistivity in individual carbon nanotubes. Furthermore, other methods, such as plasma CVD or the like can also be used to fabricate the nanotubes of the present invention.

CNT Member 200

CNT member 200 may include any electrically conductive material containing carbon nanotubes. In an embodiment, CNT member 200 may include a non-woven sheet of nanotubes or a nanotube yarn, as described in more detail below. In another embodiment, CNT member 200 may include a dispersion of nanotubes, such as a nanotube-containing film or a printed nanotube ink. In yet another embodiment, CNT member 200 may include a nanotube array. For ease of reference, CNT member 200 may also be referred to herein as a nanostructured member.

Figure 3:
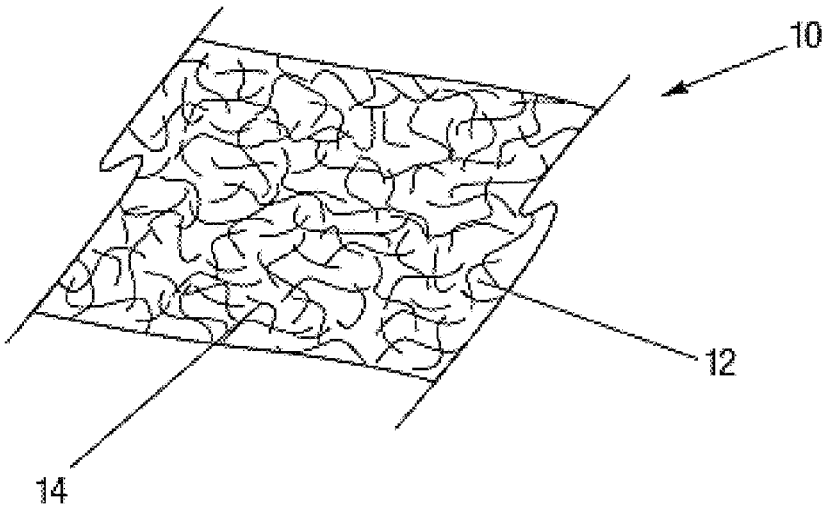
FIG. 3 depicts a carbon nanotube member according to an embodiment of the present disclosure.

Looking now at FIG. 3, the present invention provides, in an embodiment, a CNT strip 10 made from a nanostructured CNT sheet 12. The CNT strip 10 can be so designed to allow electrical conductivity along its length, i.e., within the plane of the CNT sheet 12. As shown in FIG. 3, the CNT strip 10 may include a substantially planar body in the form of a single CNT sheet 12. The sheet 12 may, in one embodiment, be a single layer of a plurality of non-woven carbon nanotubes 14 deposited on top of one another from a cloud of CNT, or alternatively be multiple layers 51, each layer being a plurality of non-woven nanotubes deposited on top of one another from a cloud of CNT (see FIG. 4). In case of a multiple-layer sheet, the plurality of non-woven carbon nanotubes forms a phyllo-dough structure whereby each layer includes a plurality of non-woven carbon nanotubes deposited on top of one another from a cloud of CNT. In other embodiments, the CNT strip 10 can be one or more CNT yarns. The strip can be a single yarn, or a plurality of yarns bundled or twisted together to form a larger yarn. Examples of CNT yarns are described in U.S. Pat. No. 7,993,620 (filed Jul. 17, 2006), which is incorporated herein by reference in its entirety.

Figure 5:
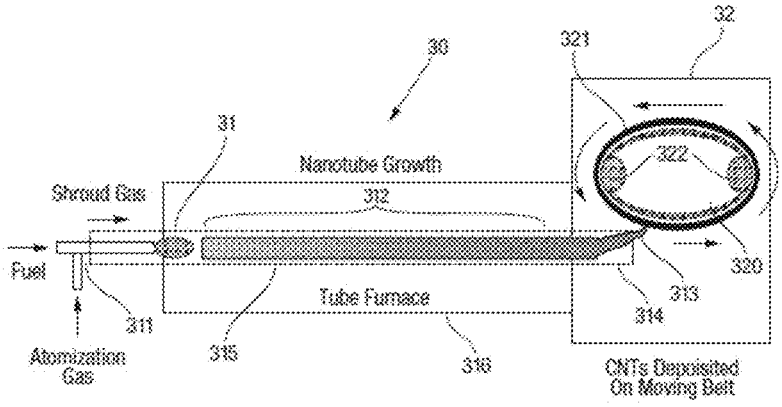
FIG. 5 depicts a system for forming a carbon nanotube sheet according to an embodiment of the present disclosure.

With reference now to FIG. 5, there is illustrated a system 30, similar to that disclosed in U.S. Pat. No. 7,993,620 (incorporated herein by reference), for use in the fabrication of nanotubes. System 30, in an embodiment, may be coupled to a synthesis chamber 31. The synthesis chamber 31, in general, includes an entrance end 311, into which reaction gases (i.e., gaseous carbon source) may be supplied, a hot zone 312, where synthesis of extended length nanotubes 313 may occur, and an exit end 314 from which the products of the reaction, namely the nanotubes and exhaust gases, may exit and be collected. The synthesis chamber 31, in an embodiment, may include a quartz tube 315 extending through a furnace 316. The nanotubes generated by system 30, on the other hand, may be individual single-walled nanotubes, bundles of such nanotubes, and/or intertwined single-walled nanotubes. In particular, system 30 may be used in the formation of a substantially continuous non-woven sheet generated from compacted and intermingled nanotubes and having sufficient structural integrity to be handled as a sheet.

System 30, in one embodiment of the present invention, may also include a housing 32 designed to be substantially airtight, so as to minimize the release of airborne particulates from within the synthesis chamber 31 into the environment. The housing 32 may also act to prevent oxygen from entering into the system 30 and reaching the synthesis chamber 31. In particular, the presence of oxygen within the synthesis chamber 31 can affect the integrity and compromise the production of the nanotubes 313. System 30 may also include an injector similar to those disclosed in application Ser. No. 12/140,263, incorporated herein by reference in its entirety.

System 30 may also include a moving belt 320, positioned within housing 32, designed for collecting synthesized nanotubes 313 made from a CVD process within synthesis chamber 31 of system 30. In particular, belt 320 may be used to permit nanotubes collected thereon to subsequently form a substantially continuous extensible structure 321, for instance, a non-woven sheet. Such a sheet may be generated from a matrix of compacted, substantially non-aligned, and intermingled nanotubes 313, bundles of nanotubes, or intertwined nanotubes, with sufficient structural integrity to be handled as a sheet.

Figure 6A:
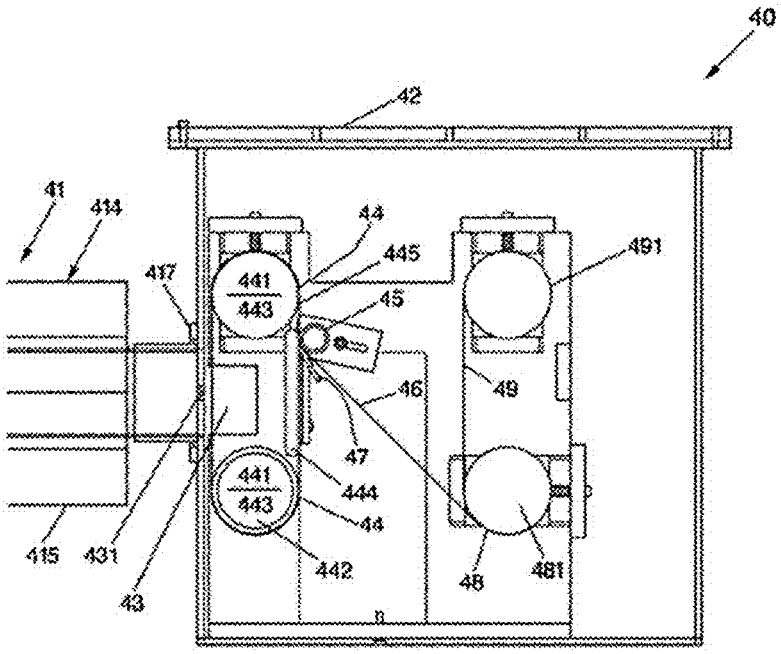
FIGS. 6A and 6B depict a system for harvesting a carbon nanotube sheet according to an embodiment of the present disclosure.
Figure 6B:
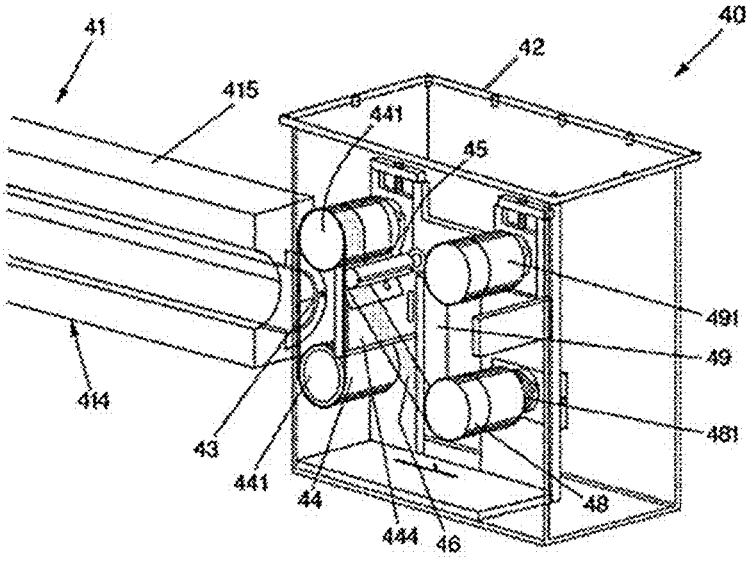

To collect the fabricated nanotubes 313, belt 320 may be positioned adjacent the exit end 314 of the synthesis chamber 31 to permit the nanotubes to be deposited on to belt 320. In one embodiment, belt 320 may be positioned substantially parallel to the flow of gas from the exit end 314, as illustrated in FIG. 5. Alternatively, belt 320 may be positioned substantially perpendicular to the flow of gas from the exit end 314 and may be porous in nature to allow the flow of gas carrying the nanomaterials to pass therethrough, as shown in FIGS. 6A and 6B. In one embodiment, belt 320 can be designed to translate from side to side in a direction substantially perpendicular to the flow of gas from the exit end 314, so as to generate a sheet that is substantially wider than the exit end 314. Belt 320 may also be designed as a continuous loop, similar to a conventional conveyor belt, such that belt 320 can continuously rotate about an axis, whereby multiple substantially distinct layers of CNT can be deposited on belt 320 to form a sheet 321, such as that shown in FIG. 4. To that end, belt 320, in an embodiment, may be looped about opposing rotating elements 322 and may be driven by a mechanical device, such as an electric motor. In one embodiment, the mechanical device may be controlled through the use of a control system, such as a computer or microprocessor, so that tension and velocity can be optimized. The deposition of multiple layers of CNT in formation of sheet 321, in accordance with one embodiment of the present invention, can result in minimizing interlayer contacts between nanotubes. Specifically, nanotubes in each distinct layer of sheet 321 tend not to extend into an adjacent layer of sheet 321. As a result, normal-to-plane thermal conductivity can be minimized through sheet 321.

To extent desired, a pressure applicator, such as roller 45, may be employed. Referring to FIGS. 6A and 6B, the pressure application may be situated adjacent to belt 44, that may be positioned substantially perpendicular to the flow of gas, so as to apply a compacting force (i.e., pressure) onto the collected nanomaterials. In particular, as the nanomaterials get transported toward roller 45, the nanomaterials on belt 44 may be forced to move under and against roller 45, such that a pressure may be applied to the intermingled nanomaterials while the nanomaterials get compacted between belt 44 and roller 45 into a coherent substantially-bonded sheet 46. To enhance the pressure against the nanomaterials on belt 44, a plate 444 may be positioned behind belt 44 to provide a hard surface against which pressure from roller 45 can be applied. It should be noted that the use of roller 45 may not be necessary should the collected nanomaterials be ample in amount and sufficiently intermingled, such that an adequate number of contact sites exists to provide the necessary bonding strength to generate the sheet 46. In various embodiments, non-woven CNT sheet embodiments of CNT member 200 may have carbon nanotube densities ranging from about 20% to about 90%, and preferably around 80% by volume.

To disengage the sheet 46 of intermingled nanomaterials from belt 44 for subsequent removal from housing 42, a scalpel or blade 47 may be provided downstream of the roller 45 with its edge against surface 445 of belt 44. In this manner, as sheet 46 moves downstream past roller 45, blade 47 may act to lift the sheet 46 from surface 445 of belt 44. In an alternate embodiment, a blade does not have to be in use to remove the sheet 46. Rather, removal of the sheet 46 may be manually by hand or by other known methods in the art.

Additionally, a spool or roller 48 may be provided downstream of blade 47, so that the disengaged sheet 46 may subsequently be directed thereonto and wound about roller 48 for harvesting. As the sheet 46 is wound about roller 48, a plurality of layers may be formed. Of course, other mechanisms may be used, so long as the sheet 46 can be collected for removal from the housing 42 thereafter. Roller 48, like belt 44, may be driven, in an embodiment, by a mechanical drive, such as an electric motor 481, so that its axis of rotation may be substantially transverse to the direction of movement of the sheet 46.

In order to minimize bonding of the sheet 46 to itself as it is being wound about roller 48, a separation material 49 (see FIGS. 6A and 6B) may be applied onto one side of the sheet 46 prior to the sheet 46 being wound about roller 48. The separation material 49 for use in connection with the present invention may be one of various commercially available metal sheets or polymers that can be supplied in a continuous roll 491. To that end, the separation material 49 may be pulled along with the sheet 46 onto roller 48 as sheet 46 is being wound about roller 48. It should be noted that the polymer comprising the separation material 49 may be provided in a sheet, liquid, or any other form, so long as it can be applied to one side of sheet 46. Moreover, since the intermingled nanotubes within the sheet 46 may contain catalytic nanoparticles of a ferromagnetic material, such as Fe, Co, Ni, etc., the separation material 49, in one embodiment, may be a non-magnetic material, e.g., conducting or otherwise, so as to prevent the sheet 46 from sticking strongly to the separation material 49. In an alternate embodiment, a separation material may not be necessary.

After the sheet 46 is generated, it may be left as a sheet 46 or it may be cut into smaller segments, such as strips. In an embodiment, a laser may be used to cut the sheet 46 into strips. The laser beam may, in an embodiment, be situated adjacent the housing such that the laser may be directed at the sheet 46 as it exits the housing. A computer or program may be employed to control the operation of the laser beam and also the cutting of the strip. In an alternative embodiment, any mechanical means or other means known in the art may be used to cut the sheet 46 into strips.

To the extent desired, an electrostatic field (not shown) may be employed to align the nanotubes, generated from synthesis chamber 31, approximately in a direction of belt motion. The electrostatic field may be generated, in one embodiment, by placing, for instance, two or more electrodes circumferentially about the exit end 314 of synthesis chamber 31 and applying a high voltage to the electrodes. The voltage, in an embodiment, can vary from about 10 V to about 100 kV, and preferably from about 4 kV to about 6 kV. If necessary, the electrodes may be shielded with an insulator, such as a small quartz or other suitable insulator. The presence of the electric field can cause the nanotubes moving therethrough to substantially align with the field, so as to impart an alignment of the nanotubes on moving belt.

Alternatively, the carbon nanotubes can be aligned by stretching following the synthesis of the carbon nanotube sheets as provided in co-pending U.S. application Ser. No. 12/170,092, which is incorporated herein by reference in its entirety.

Figure 4:
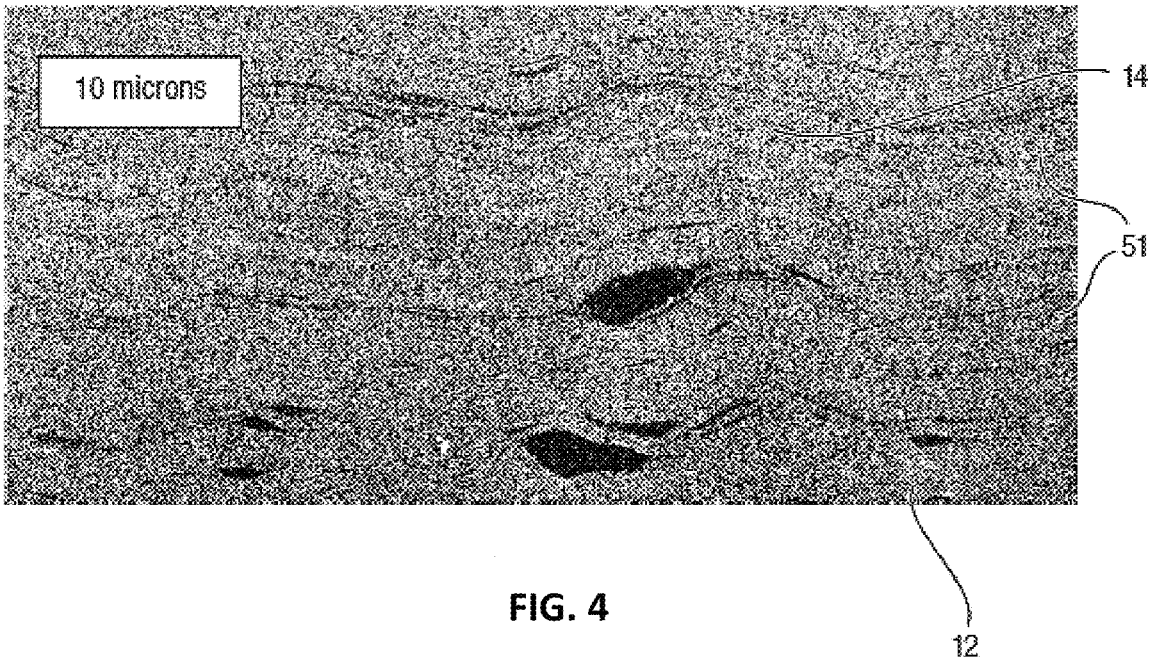
FIG. 4 depicts a cross-sectional view of a phyllo-dough arrangement of nanotubes within a CNT sheet according to an embodiment of the present disclosure.

System 30, as noted, can provide bulk nanomaterials of high strength in a non-woven sheet, as shown in FIG. 4. The carbon nanotubes 14, in an embodiment, can be deposited in multiple distinct layers 51 to from a multilayered structure or morphology in a single CNT sheet 12, as shown in FIG. 4. As noted above, nanofibrous non-woven sheet 110 may be made from the deposition of multiple distinct layers of either SWNT or MWNT carbon nanotubes. In an embodiment, the tensile strength of such a non-woven sheet 110 can be over 40 MPa for SWNT. Moreover, such a sheet may used with residual catalyst from the formation of the nanotubes. However, typical residuals may be less than 2 atomic percent.

By providing the nanomaterials in a non-woven sheet, the bulk nanomaterials can be easily handled while maintaining structural integrity and subsequently processed for end use applications. Non-woven sheets and yarns of nanotubes of the present disclosure can exhibit an number of beneficial characteristics for heating applications. These materials are electrically conductive, have low thermal mass, are highly flexible, and are resistant to chemical degradation.

A system similar to system 30 may also be used for manufacturing nanotube yarns. To manufacture yarns, housing 32 can be replaced with an apparatus to receive nanotubes from the furnace 316 and spin them into yarns. The apparatus may include a rotating spindle that may collect nanotubes as they exit tube 315. The rotating spindle may include an intake end into which a plurality of tubes may enter and be spun into a yarn. The direction of spin may be substantially transverse to the direction of movement of the nanotubes through tube 315. Rotating spindle may also include a pathway along which the yarn may be guided toward an outlet end of the spindle. The yarn may then be collected on a spool.

It should be appreciated that the carbon nanotubes made in accordance with an embodiment of the present invention may not require treatment with a surfactant, and may be of at least three orders of magnitude better in electrical conductivity and thermal conductivity. Moreover, the carbon nanotube sheets made in accordance with an embodiment of the present invention may include a plurality of layers.

In various embodiments, CNT member 200 may further include additives for enhancing infrared emission. In particular, in various embodiments, additives may be used to influence the wavelengths of the infrared energy produced. For example, in an embodiment, additives may be included to adjust the wavelengths of energy emitted in the 3-6 micron range to instead be emitted in the 8-12 micron range. Example additives suitable for the described purpose include, without limitation, photo luminescent materials phosphorescent materials. One having ordinary skill in the art will recognize other suitable additives within the scope of the present disclosure that are suitable for the stated purpose.

Carbonaceous Member 500

In various embodiments, a member 500 including a carbonaceous material (hereinafter referred to as carbonaceous member 500) may be used in place of CNT member 200. Accordingly, it should be recognized that while the present disclosure primarily describes directed infrared heater 100 as comprising CNT member 200, in various embodiments, directed infrared heater 100 may additionally or alternatively include carbonaceous member 500. Like CNT member 200, some embodiments of carbonaceous member 500 may include additives for enhancing its ability to generate infrared energy and/or to help tailor the wavelength(s) of the generated infrared energy.

Carbonaceous member 500 may include any electrically conductive carbonaceous material capable of emitting infrared energy when an electrical current is applied thereto. Representative examples of suitable carbonaceous materials include, without limitation, graphene, graphite, and carbon black. In some cases, the carbonaceous material may be commercially available in sheets, such as a Grafoil sheet or a graphene sheet; however, in other cases, it may be necessary to couple the carbonaceous material to a substrate or other form of support to form carbonaceous member 500. For example, in some embodiments, the carbonaceous material, such as a graphite- or conductive carbon black-based ink may be coated or deposited onto the substrate. Many of these inks are commercially available from companies like DuPont and Mereco.

In yet another embodiment, CNT member 200 may be combined with a carbonaceous material to form a hybrid material. For example, CNT member 200 may be soaked in graphene ink, carbon black ink, or the like, to form the hybrid material. Representative concentrations of the ink may range up to about 50% by volume in CNT member 200. The resulting hybrid material may exhibit increased conductivity.

Reflective Member 300 and Spacer 400

Figure 7A:
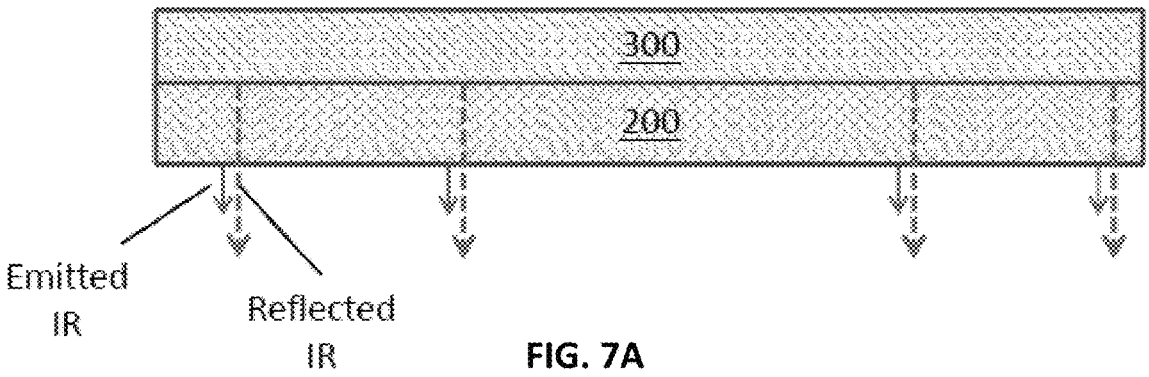
FIG. 7A depicts a directed infrared heater according to an embodiment of the present disclosure.
Figure 7B:
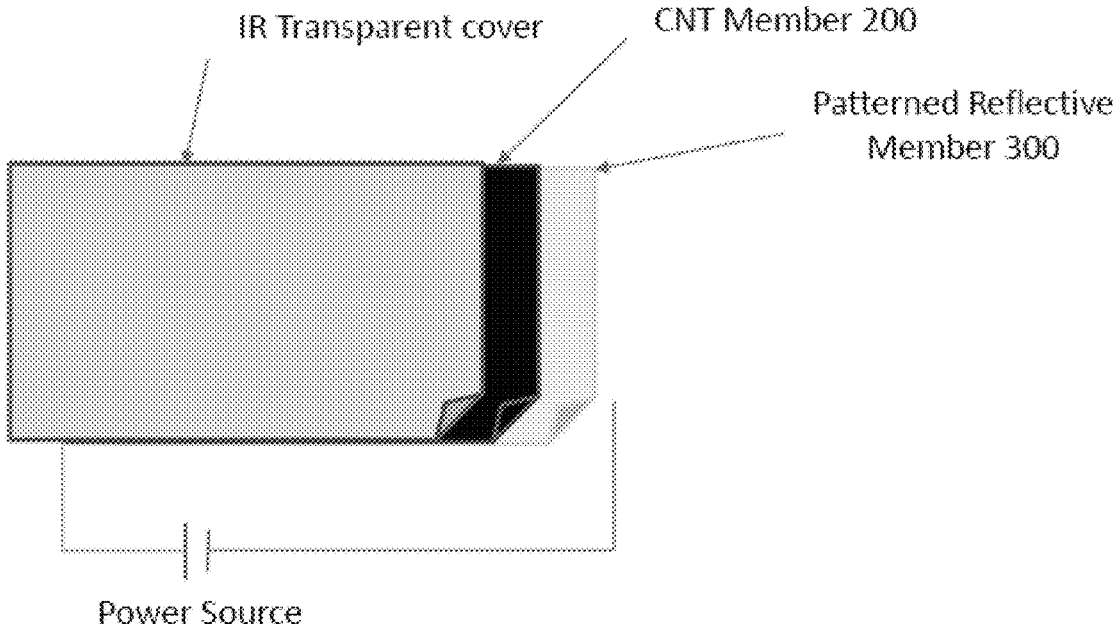
FIG. 7B depicts a directed infrared heater according to another embodiment of the present disclosure.

Referring now to FIGS. 7A and 7B, directed infrared heater 100 may further comprise a reflective member 300. In various embodiments, reflective member 300 may be configured to direct infrared energy generated by CNT member 200 in a desired direction(s). Additionally or alternatively, reflective member 300 may be configured to concentrate the directed infrared energy to enhance its effect and efficiency.

Reflective member 300, in an embodiment, may be of any material and construction suitable for reflecting the infrared energy emitted from CNT member 200. Example reflective materials may include, without limitation, silver, gold, or other metallic materials having properties capable of reflecting infrared energy emitted from CNT member 200. Reflective member 300, in preferred embodiments, should be capable of reflecting at least 80% of the infrared energy emitted from CNT member 200 in order to avoid heating reflective member 300 itself. Most metals are typically capable of reflecting about 85% to 95% of infrared energy, with gold and similar metals performing at the upper end of the spectrum with about 97% effectiveness. In an embodiment, reflective member 300 may include a self-standing reflective material, such as Mylar or aluminized Mylar. In another embodiment, reflective member 300 may include a reflective material that is deposited or otherwise applied to or supported by a substrate. Any suitable substrate, such as a polymeric film, may be utilized for structural support of the reflective material. The reflective material and supporting substrate may be joined in any suitable manner including, without limitation, deposition of the reflective material on the substrate, use of a coupling agent (e.g., adhesive), or application of materials to seal the reflective material against a surface of the substrate (e.g., a polymeric sealant layer). One of ordinary skill in the art will recognize that these are merely illustrative examples of suitable reflective materials, substrates, and combinations thereof, and that the present invention is not intended to be limited to just these illustrative embodiments.

CNT member 200 and reflective member 300 may be coupled to one another to form directed infrared heater 100. In one embodiment, CNT member 200 and reflective member 300 may be joined using an adhesive such as pressure sensitive acrylate or thermoset acrylics. In another embodiment, CNT member 200 may be laminated to reflective member reflective member 300. An example configuration includes a non-woven sheet of nanotubes having a nanotube area density of about 10 grams per square meter (gsm) laminated to a Mylar or aluminized Mylar. Of course, any suitable method and mediums may be used to couple CNT member 200 and reflective member 300.

FIG. 7B illustrates a flexible embodiment of directed infrared heater 100 including a flexible CNT sheet 200 and a flexible reflective member 300, which is patterned to enhance its reflective properties.

Figure 8A:
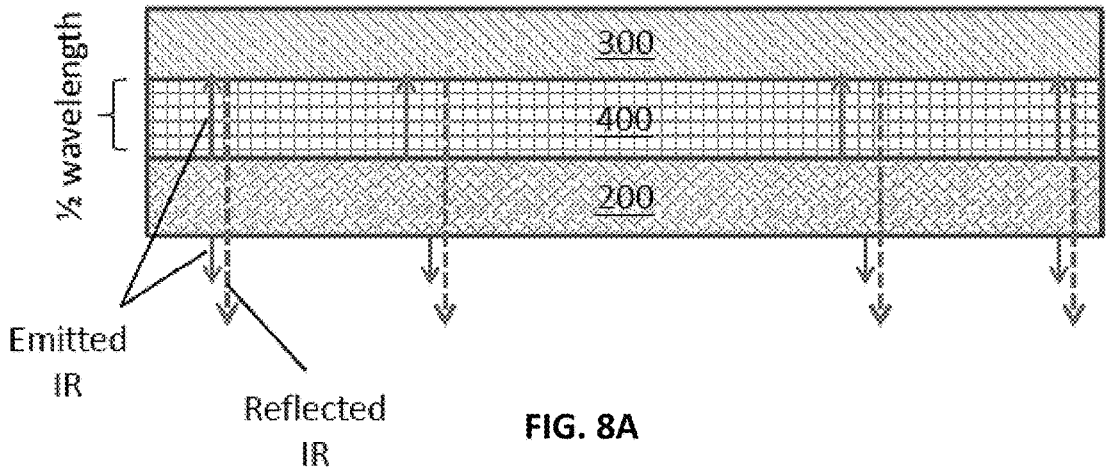
FIG. 8A depicts directed infrared heater having a spacer according to an embodiment of the present disclosure.
Figure 8B:
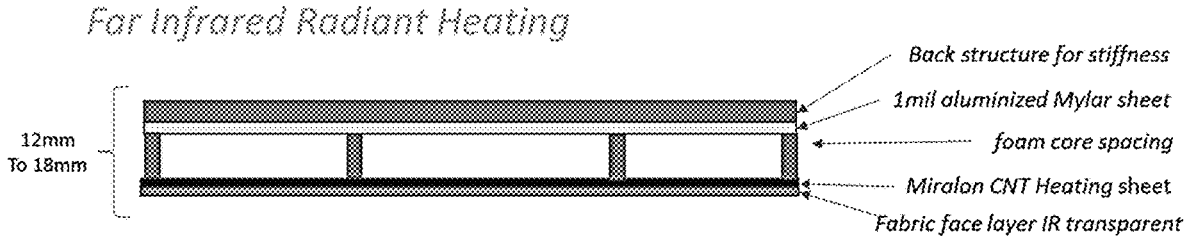
FIG. 8B depicts directed infrared heater having a spacer according to another embodiment of the present disclosure.

Referring now to FIGS. 8A and 8B, directed infrared heater 100 may further include a spacer 400 situated between CNT member 200 and reflective member 300. Spacer 400 may be configured to maintain a predetermined spacing between CNT member 200 and reflective member 300. While it is certainly envisioned that reflective member 300 may be positioned directly against CNT member 200 as in FIG. 7, it should be recognized that the efficiency of directed infrared heater 100 may be improved by positioning these components at a distance from one another so as to minimize destructive interference between emitted radiation and reflected radiation. As spacer 400 is situated between these components, in various embodiments, spacer 400 may be made of a material suitable to permit infrared energy to pass therethrough with minimal interference. In an embodiment, spacer 400 may include a honeycomb structure or other suitable structure for providing additional structural integrity to heater 100. Of course, spacer 400 need not be a another layer of material, but rather may include any suitable structure for maintaining a desired spacing between CNT member 200 and reflective member 300 (e.g., a frame, a plurality of objects or other structure). FIG. 8B illustrates an embodiment in which spacer 400 is constructed of foam.

An example configuration includes a CNT member 200 (e.g., a non-woven sheet of nanotubes) laminated to one side of a spacer 400 (e.g., honeycomb structure), and a reflective member 300 (e.g., a Mylar sheet) laminated to the other side of spacer 400. The thickness of spacer 400 may be chosen to provide a spacing between the CNT member 200 and reflective member 300 suitable to minimize destructive interference, as described below.

In various embodiments, reflective member 300 may be positioned relative to CNT member 200 at a distance configured to minimize any destructive interference that may occur when the infrared energy emitted from CNT member 200 is reflected off of reflecting member 300. Destructive interference typically occurs when incident and reflected waves interact substantially out-of-phase from one another. This may be minimized, in an embodiment, by spacing reflective member 300 apart from the infrared energy source by about half the wavelength of the infrared energy desired. For example, if it is desired to reflect infrared energy having a wavelength of about 11 microns, reflecting member 300 may be positioned about 5.5 microns from the source of that infrared energy.

In some applications, it may be desired to reflect as much infrared energy as possible towards a target, regardless of its wavelength. In such a case, reflective member 300 may be positioned at a distance from CNT member 200 suitable to minimize destructive interference of the predominant wavelength of infrared energy generated by the CNT member 200. For example, if CNT sheet generates infrared energy having a range of wavelengths, with the majority of the radiation having a wavelength of 10 microns, reflective member may be positioned at a distance equal to the half of that predominant wavelength—that is, at a distance of 5 microns.

In other applications, it may be desired to reflect infrared energy of a particular wavelength, regardless of whether it is the predominant wavelength emitted from CNT member 200. In such applications, spacing may be used, to some extent, to filter out emitted infrared energy of undesired wavelengths, and instead direct primarily that infrared energy of the desired wavelength towards a person or object to be heated.

Determining the appropriate spacing between reflecting member 300 and CNT member 200 may require an approximation of the depth within CNT member 200 from which the majority of the infrared energy desired to be reflected is emitted. This may depend on a number of properties of CNT member 200 including, for example, its thickness, density distribution of nanotubes, and degree of uniformity of the nanotubes contained therein. In an embodiment, the source of the infrared energy may be approximated at the surface of CNT member 200, especially if CNT member 200 is very thin and/or has at its surface high densities of the types of nanotubes responsible for generating the desired wavelength of infrared energy. In another embodiment, the source of the infrared energy may be approximated below the surface of CNT member 200 if, for example, CNT member 200 is thicker and/or has situated within its thickness high densities of the types of nanotubes responsible for generating the desired wavelength of infrared energy. One of ordinary skill in the art will recognize an appropriate spacing for a given application and CNT member 200 construction based on the teachings of the present disclosure.

In a preferred embodiment, directed infrared heater 100 may be configured with appropriate materials and spacing to achieve a far infrared reflection of higher than about 70% in the desired wavelength range. In various embodiments, spacing may be set to minimize destructive interference of infrared energy having wavelengths between about 8 microns and 12 microns. Studies have shown that infrared energy having wavelengths within this range is most effective for heating human beings, as illustrated in FIG. 2B. Of course, the present disclosure is not intended to be limited as such, and directed infrared heater 100 may be configured to generate and direct infrared energy of any suitable wavelength or range of wavelengths for a given application.

In some embodiments, directed infrared radiator article 100 may further include a cover member to protect CNT member 200 from physical damage and exposure to the elements or harmful chemicals. It should be appreciated that in the cover member should be sufficiently transparent to infrared energy so as not to inhibit the emitted and reflected infrared energy being directed therethrough towards the target. FIGS. 7B and 8B illustrate embodiments of directed infrared radiator article 100 including such a cover member.

Figure 9A:
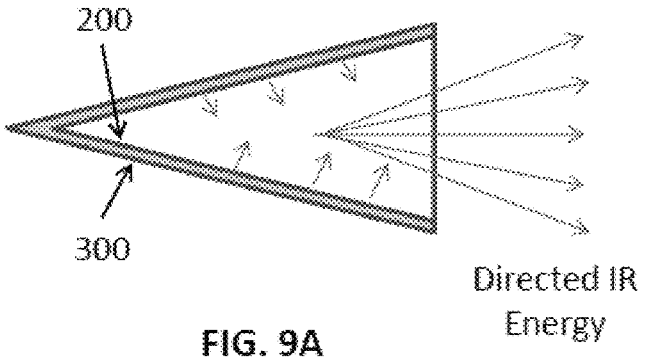
FIGS. 9A and 9B depict a conical directed infrared heater according to embodiments of the present disclosure.
Figure 9B:
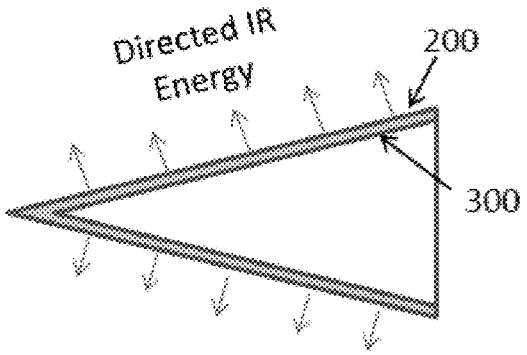
Figure 10A:
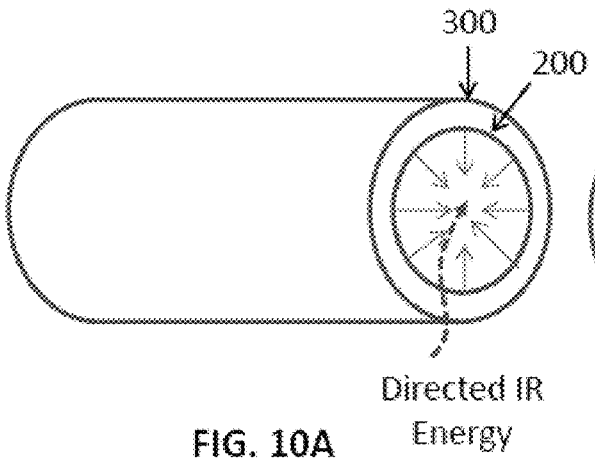
FIGS. 10A and 10B depict a cylindrical directed infrared heater according to embodiments of the present disclosure.
Figure 10B:
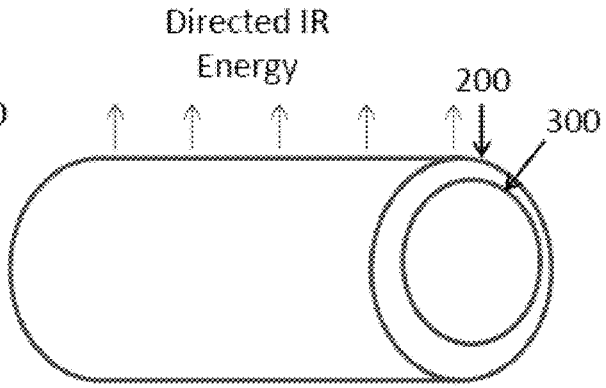

Referring now to FIGS. 9A-9B and 10A-10B, directed infrared heater 100, in various embodiments, may be shaped to form a controlled profile of infrared energy, such as a focused beam or a diffuse cone of radiation. To that end, CNT member 200, reflective member 300, and (optionally) spacer 400 may be shaped and coupled in any manner suitable to reflect infrared energy emitted from CNT member 200 to form the desired profile. In an embodiment, as shown in FIG. 9A, these components may be joined to form a conical heater 100 having CNT member 200 forming an inner surface of the cone and reflective member 300 forming an outer surface of the cone. In such a configuration, reflective member 300 may serve to concentrate infrared energy emitted by CNT member 200 within the cone and direct it out of the open end of the cone towards a person or object to be heated. In another embodiment, as shown in FIG. 9B, the positions of CNT member 200 and reflective member 300 may be reversed in the cone-shaped heater, such that reflective member 300 serves to direct a broad, diffuse array of infrared energy outwards and towards the point of the cone. Of course, similar embodiments are envisioned for other sorts of concave and convex shapes. In further embodiments, directed infrared heater 100 may be cylindrical in shape, as shown in FIGS. 10A and 10B, so as to focus infrared energy towards a person or object located towards its center or to direct more diffuse energy outwards towards persons or objects located about the cylindrical heater 100, respectively. In yet another embodiment, directed infrared heater 100 may be substantially planar in shape, as shown in FIGS. 1A and 1B. Such an embodiment may be used to direct infrared energy normal to its surface to heat a person or object located in front of that surface. Of course, these are merely illustrative configurations, and one of ordinary skill in the art will recognize any number of suitable configurations within with scope of the present disclosure.

Advantages and Applications

Directed infrared heaters of the present disclosure exhibit good electrical conduction whilst being resistant enough to provide Ohmic heating.

The low thermal mass of these heaters allows them to heat people or objects relatively quickly and, unlike many other forms of heaters, does not stay hot for an extended period of time after being turned off. This reduces the potential for any safety hazards associated with use of these heaters, and also enhances the precision with which these heaters may be used in various applications.

Further, heaters of the present disclosure can be highly flexible and can be bent through, for example, extreme radii without breakage or compromise of infrared heating capability. Unlike metals or ceramics, they do not break or fatigue as easily, will not corrode, and are impervious to chemicals.

Various embodiments of the directed infrared heaters disclosed herein may be used in a variety of applications. In various embodiments, the heaters may be used to provide warmth to human beings. For example, they may be incorporated into awnings, umbrellas, heating blankets, body wraps, car seats, car side panels, baby incubator linings, and the like. In other embodiments, the heaters may be used to remotely heat objects. In yet another embodiment, the heaters may be used in a grow matt for plants. The remote infrared heating provided by the heaters disclosed herein provide for efficient heating applications without the drawbacks of heating the space surrounding a person or object to be heated.

While the present invention has been described with reference to certain embodiments thereof, it should be understood by those skilled in the art that various changes may be made and equivalents may be substituted without departing from the true spirit and scope of the invention. In addition, many modifications may be made to adapt to a particular situation, indication, material and composition of matter, process step or steps, without departing from the spirit and scope of the present invention. All such modifications are intended to be within the scope of the claims appended hereto.

What is claimed is:

1. An article for emitting directed infrared energy, comprising:

an input for receiving energy from a power source;

a sole nanostructured sheet comprising a plurality of nanotubes, wherein the nanotubes are substantially non-aligned and have an adequate number of contact sites therebetween such that the nanostructured sheet has sufficient structural integrity to be handled as a sheet, and wherein the nanostructured sheet is configured to emit infrared energy when an electrical current is applied via the input from the power source; and a reflecting member directly or indirectly coupled to the nanostructured sheet, the reflecting member configured to direct at least a portion of the emitted infrared energy in a desired direction for heating a remotely-situated target; and a spacer situated between the nanostructured sheet and the reflecting member, wherein the spacer comprises a honeycomb structure.

2. The article as set forth in claim 1, wherein the nanostructured sheet includes a plurality of layers of non-woven, substantially non-aligned nanotubes deposited on top of one another to form a phyllo-dough structure.

3. The article as set forth in claim 1, wherein the nanostructured sheet has a nanotube area density of about 10 grams per square meter.

4. The article as set forth in claim 1, wherein the reflecting member is a self-standing reflective material.

5. The article as set forth in claim 1, wherein the reflecting member includes a reflective material deposited onto a substrate.

6. The article as set forth in claim 1, wherein the nanostructured sheet and the reflecting member are directly coupled to one another.

7. The article as set forth in claim 6, wherein the nanostructured sheet and the reflecting member are directly coupled to one another via an adhesive or polymeric sealant layer.

8. The article as set forth in claim 1, wherein the spacer has a thickness equal to about one half of a desired wavelength of the infrared radiation to be directed in the desired direction for heating the remotely-situated target.

9. The article as set forth in claim 1, wherein the spacer has a thickness of between about 4 microns and about 6 microns.

10. The article as set forth in claim 9, wherein the spacer is configured to space apart the nanostructured sheet and the reflecting member to minimize destructive interference for emitted infrared radiation having wavelengths ranging between about 8 microns and about 12 microns.

11. The article as set forth in claim 10, wherein the remotely-situated target is a human being or animal.

12. The article as set forth in claim 1, wherein the article is substantially cylindrical or conical in shape.

13. The article as set forth in claim 12, wherein the reflecting member forms an outer surface of the article so as to concentrate the emitted infrared energy within a central portion of the article.

14. The article as set forth in claim 12, wherein the reflecting member forms an inner surface of the article so as to direct the emitted infrared energy outwards.

15. An article for emitting directed infrared energy, comprising:

a sole nanostructured sheet comprising a plurality of nanotubes, wherein the plurality of nanotubes are substantially non-aligned and have an adequate number of contact sites therebetween such that the nanostructured sheet has sufficient structural integrity to be handled as a sheet, and wherein the nanostructured sheet is configured to emit infrared energy when an electrical current is applied to the nanostructured sheet;

a reflecting member configured to reflect at least a portion of the emitted infrared energy in a desired direction for heating a remotely-situated target; and a spacer situated between the nanostructured sheet and the reflecting member to maintain a predetermined spacing there between, the predetermined spacing selected to minimize destructive interference between the infrared energy emitted by the nanostructured sheet and the infrared energy reflected by the reflecting member, wherein wherein the spacer comprises a honeycomb structure.

16. The article as set forth in claim 15, wherein the predetermined spacing is equal to about one half of a desired wavelength of the infrared radiation to be reflected in the desired direction for heating the remotely-situated target.

17. The article as set forth in claim 15, wherein the predetermined spacing is equal to about one half of a predominant wavelength of the infrared radiation emitted by the nanostructured sheet.

18. The article as set forth in claim 15, wherein the predetermined spacing is configured to minimize destructive interference for infrared energy having wavelengths between about 8 microns and about 12 microns.

19. An article for emitting directed infrared energy, comprising:

an input for receiving energy from a power source;

a sole carbonaceous sheet including a plurality of carbon nanotubes and at least one of graphene, graphite, carbon black, or other carbon-based material capable of emitting infrared energy when an electrical current is applied via the input from the power source;

a reflecting member directly or indirectly coupled to the carbonaceous sheet, the reflecting member configured to direct at least a portion of the emitted infrared energy in a desired direction for heating a remotely-situated target; and a spacer situated between the nanostructured sheet and the reflecting member, wherein the spacer comprises a honeycomb structure.

* * * * *